US005809382A

United States Patent [19]

McGuire et al.

[11] Patent Number: 5,809,382

[45] Date of Patent: Sep. 15, 1998

[54] DAD, DAD, DAD SINGLE-PASS COLOR PRINTING

[75] Inventors: Peter J. McGuire, Holne, England; Thomas M. Baretsky, Fairport, N.Y.

[73] Assignee: Xerox Corporation, Stamford, Conn.

[21] Appl. No.: 720,648

[22] Filed: Oct. 2, 1996

[51] Int. Cl.[6] ..... G03G 15/01; G03G 15/06

[52] U.S. Cl. ..... 399/232; 399/223; 430/120

[58] Field of Search ..... 399/53, 54, 222, 399/223, 231, 232; 430/120, 122

[56] References Cited

U.S. PATENT DOCUMENTS

| | | | |
|---|---|---|---|
| 4,078,929 | 3/1978 | Gundlach | 430/42 |
| 4,731,634 | 3/1988 | Stark | 399/232 |
| 4,984,021 | 1/1991 | Williams | 399/232 |
| 5,049,949 | 9/1991 | Parker et al. | 399/232 |
| 5,155,541 | 10/1992 | Loce et al. | 399/232 |
| 5,221,954 | 6/1993 | Harris | 399/232 |
| 5,241,356 | 8/1993 | Bray et al. | 399/232 |
| 5,459,563 | 10/1995 | Fuma et al. | 399/223 |
| 5,534,990 | 7/1996 | Harris | 399/223 |

*Primary Examiner*—Arthur T. Grimley
*Assistant Examiner*—Sophia S. Chen

[57] ABSTRACT

A method for and apparatus for creating partial gamut color images in a single pass. A plurality of latent discharged area images are formed using a single exposure. A first discharged area image is developed followed by recharging of the photoreceptor containing the images. The images are then subjected to a partial erase step followed by the development of a second discharged area image. All images formed subsequent to the first discharged image except for the last image are preceded by recharging and partial erase to thereby optimize development and cleaning fields.

18 Claims, 9 Drawing Sheets

DAD, DAD, DAD SINGLE-PASS COLOR PRINTING

BACKGROUND OF THE INVENTION

This invention relates generally to color imaging and more particularly to creating partial gamut color documents utilizing a modified tri-level imaging process.

The tri-level highlight color xerographic process is one method of making single pass, partial gamut color images. The basic concept of tri-level xerography is described in U.S. Pat. No. 4,078,929 issued in the name of Gundlach. In this process, the latent image is created by first charging the photoreceptor(p/r) to some initial charge level ($V_0$), and then exposing the p/r to three discrete voltage levels using a Raster Output Scanner (ROS). The two voltages that represent the document information are commonly referred to as the Charged Area Development potential ($V_{CAD}$) and the Discharged Area Development potential ($V_{DAD}$). The third voltage represents the white or background potential ($V_{WHITE}$ or $V_{bkg}$), and corresponds to the background areas or those areas of the final substrate that are to be white. $V_{CAD}$ is generated when the ROS output is minimum (off), and is roughly equal to $V_0$. $V_{DAD}$, on the other hand, is generated when the ROS output is maximum (on full), and is typically equal to the residual potential (100 v) of the p/r. $V_{WHITE}$ is generated when ROS output is approximately at half power, and is typically equal to $V_0/2$.

Once the tri-level latent image is formed, it is then developed by passing it sequentially through or past two independent developer housings, each containing one of the two required developers. In theory, either of these housings can contain either color developer, and either color developer (specifically, the toner) can be either positive or negative in charge, as long as the two developers are opposite in polarity. For the purpose of this discussion, black developer with positive toner resides in the first housing, and a color developer with negative toner resides in the second housing.

As the latent image passes in close proximity to the first housing, the positive black toner is attracted to and finally deposited in the more negative areas of the p/r, called $V_{CAD}$, and development continues until the $V_{CAD}$ surface potential roughly equals that of the first developer housing bias ($V_{CAD\ bias}$). This bias, which is typically approximately equal 100 v more negative then $V_{WHITE}$, creates a cleaning field between this housing and both $V_{WHITE}$ and $V_{DAD}$, thus suppressing development of black toner in these areas. When the latent images are passed through the second housing, the negative color toner is deposited in the less negative areas of the p/r, called $V_{DAD}$, until the $V_{DAD}$ surface potential roughly equals that of the second housing bias ($V_{DAD}$ bia) This bias is typically approximately equal 100 v less negative than $V_{WHITE}$, and creates a cleaning field between this housing and both $V_{WHITE}$ and the residual $V_{CAD}$ which suppresses development of the negative color toner in these areas.

After development of the tri-level image is complete, one additional step must be implemented prior to transfer. It must be exposed to a pre-transfer corona (either positive or negative) to make the toners common in sign. Once this is done, the image is then be transferred to a final substrate such as plain paper using conventional electrostatic transfer.

Following is a discussion of (additional) prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 5,155,541 discloses a method and apparatus for printing toner images in black and at least two highlighting colors in a single pass of the imaging surface through the processing areas of the printing apparatus. Imaging and development techniques of color photography and tri-level xerography are combined to produce images with black and two colors wherein the two highlighting colors are developed with only one color toner. A single imaging step forms a four level charge pattern on a charge retentive surface followed by development of two of the image levels using tri-level imaging techniques. Uniform exposure of the imaging surface, similar to that used to color photography techniques precedes development of the last image. The uniform exposure modifies the last developed image level and the background charge level allowing development of the last image with a single toner.

U.S. Pat. No. 4,731,634 discloses a method and apparatus for rendering latent electrostatic images visible using multiple colors of dry toner or developer and more particularly to printing toner images in black and at least two highlighting colors in a single pass of the imaging surface through the processing areas of the printing apparatus. Two of the toners are attracted to only one charge level on a charge retentive surface to thereby providing black and one highlight color while two toners are attracted to another charge level to form the second highlight color.

U.S. Pat. No. 5,534,990 discloses a single pass full color printing system consists generally of a raster output scanner (ROS) optical system and a quad-level xerographic unit and a penta-level xerographic unit in tandem. This full color printing system produces pixels of black and white and all six primary colors without toner upon toner.

U.S. Pat. No. 5,221,954 discloses a four color toner single pass color printing system consists generally of a raster output scanner (ROS) optical system and a quad-level xerographic unit and a tri-level xerographic unit in tandem. The resulting color printing system would be able to produce pixels of black and white and all six primary colors. The color printing system uses a black toner and toners of the three subtractive primary colors or just toners of the three subtractive primary colors.

U.S. patent application Ser. No. 08/347,617 discloses a multi-color imaging apparatus utilizing recharging between two image creation steps for recharging a charge retentive surface to a predetermined potential prior to forming a second of the two images. The two images are formed using toner particles which are subject to under color splatter (UCS). The UCS phenomena occurs when a developed image passes through a toner cloud created by a certain type of scavengeless development system. The forgoing problem is obviated by applying pressure to toner images prior to their passage through a developer housing.

One of the shortcomings of the tri-level type of highlight color imaging is that because the image voltage is only half of that of conventional xerography, the development fields are relatively small. Moreover, attempts at extending the color gamut using tri-level imaging resulted in even smaller development fields.

Another shortcoming of conventional tri-level color imaging is the use of different polarities toners which necessitates the use of a pretransfer device for converting one of the toner's polarity to that of the other toner or toners.

Another consideration that must be made when creating images using the tri-level process is that of cleaning fields.

Smaller cleaning fields are inherent in tri-level imaging due to incomplete charge neutralization of a first developed image passing through a second developer housing structure.

As will be appreciated, it is desirable, in the type of imaging contemplated to optimize cleaning and development fields and to eliminate the need for pretransfer treatment of different polarity toners to insure monopolar polarity images at the transfer station.

BRIEF SUMMARY OF THE INVENTION

In accordance with the present invention, a partial gamut color imaging process and apparatus for carrying out the process are provided wherein recharging and partial erasing treatments are used subsequent to each image development except for the last one. The recharging serves to charge neutralize a developed image before it passes through a subsequent developer housing. Charge neutralization of a developed image, in the case of DAD images, increase the voltage level of that image to approximately the level of one of the latent images. The partial erasing serves to condition the voltage profile on the charge retentive surface so that subsequent images can be developed without unwanted toner deposition on the other images. Thus, the effect of the partial erase step is to provide voltage space between an already developed image and a nondeveloped image as well as reduce the background voltage to a suitable level.

DETAILED DESCRIPTION OF THE PREFERRED EMBODIMENT OF THE INVENTION

Figure 1A:
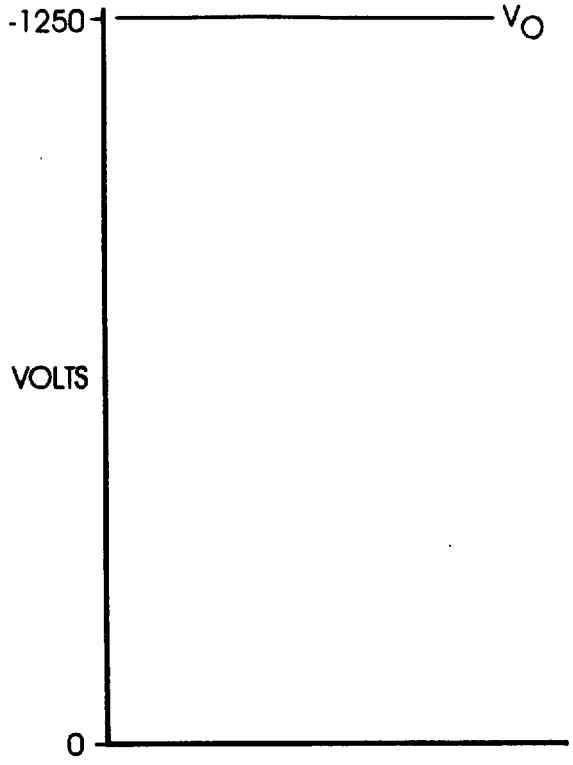
FIG. 1*a* depicts the condition of a charge retentive surface such as a photoreceptor after a uniform charging step.

For a general understanding of the operation of the developer usage measurement apparatus of the present invention, reference is made to the drawings. In the drawings, like reference numerals have been used throughout to designate identical elements.

This invention relates to an imaging system which is used to produce partial gamut color images in a single pass. Partial gamut color images are produced using a limited range of tints and/or hues. It will be understood that it is not intended to limit the invention to the embodiment disclosed. On the contrary, it is intended to cover all alternatives, modifications and equivalents as may be included within the spirit and scope of the invention as defined by the appended claims.

Figure 3:
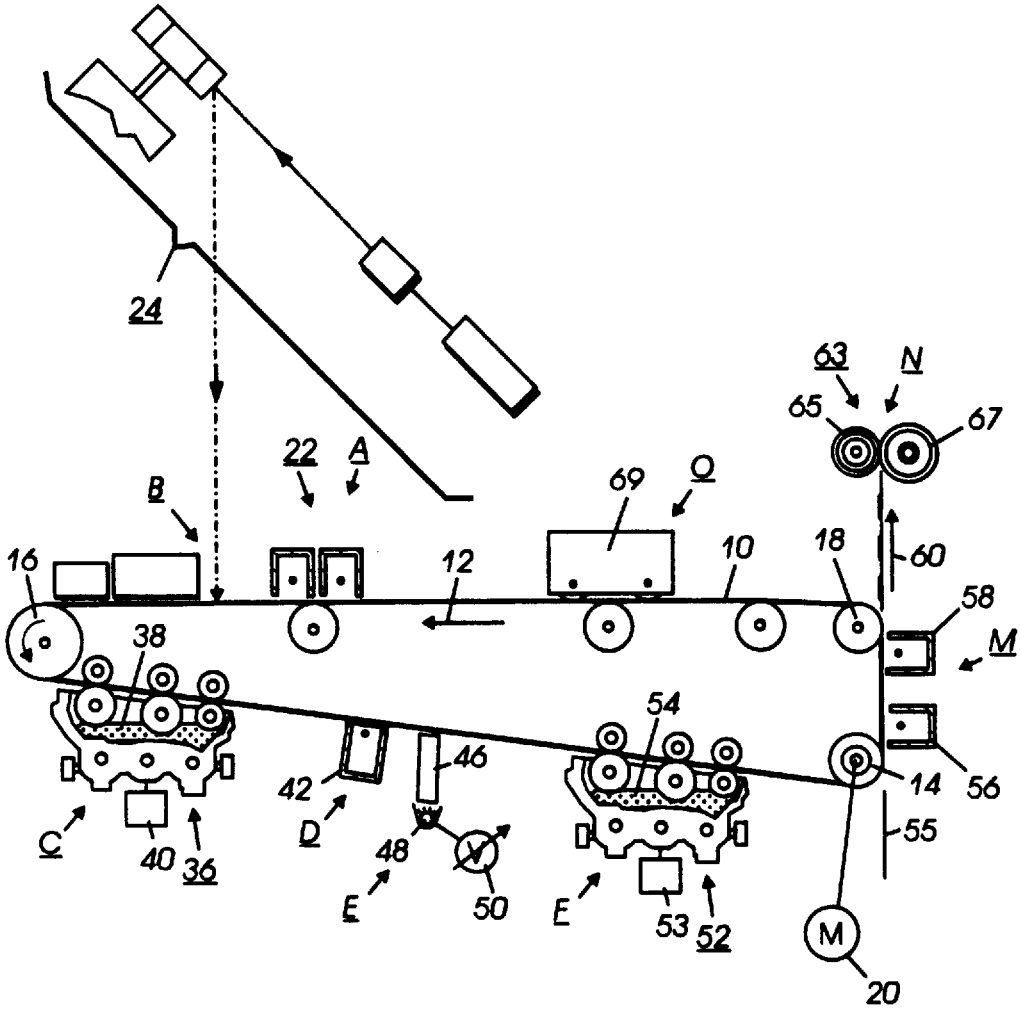
FIG. 3 is a schematic illustration of a xerographic engine incorporating the present invention.

Turning now to FIG. 3, which illustrates an electrophotographic printing machine incorporating the present invention uses a charge retentive surface in the form an Active Matrix (AMAT) photoreceptor belt 10 supported for movement in the direction indicated by arrow 12, for advancing sequentially through the various xerographic process stations. The belt is entrained about a drive roller 14 and two tension rollers 16 and 18 and the roller 14 is operatively connected to a drive motor 20 for effecting movement of the belt through the xerographic stations.

With continued reference to FIG. 3, a portion of belt 10 passes through charging station A where a corona generating device, indicated generally by the reference numeral 22, charges the photoconductive surface of belt 10 to a relative high, substantially uniform, preferably negative potential.

Next, the charged portion of photoconductive surface is advanced through an imaging station B. At exposure station B, the uniformly charged belt 10 is exposed to a laser based output scanning device 24 which causes the charge retentive surface to be discharged in accordance with the output from the scanning device. Preferably the scanning device is a two level laser Raster Output Scanner (ROS). Alternatively, the ROS could be replaced by other xerographic exposure devices.

The photoreceptor, which is initially charged to a voltage $V_0$, undergoes dark decay to a level $V_{ddp}$ equal to about −1200 volts. At the exposure station B, the ROS 24 is energized for forming a plurality of negative, monopolar, discharged area images 32 and 34 (FIG. 1*b*).

At a first development station C, a magnetic brush developer structure, indicated generally by the reference numeral 36 advances insulative magnetic brush (IMB) material 38 into contact with the electrostatic latent image 34. The development structure 36 comprises a plurality of magnetic brush roller members. These magnetic brush rollers present, for example, positively charged green toner material to the discharged image areas 34 for development thereof. Appropriate developer biasing is accomplished via power supply 40. Electrical biasing is such as to effect Discharged Area Development (DAD) of the image 34 which is at a lower voltage than the image 32 (FIG. 1*c*).

Figure 1B:
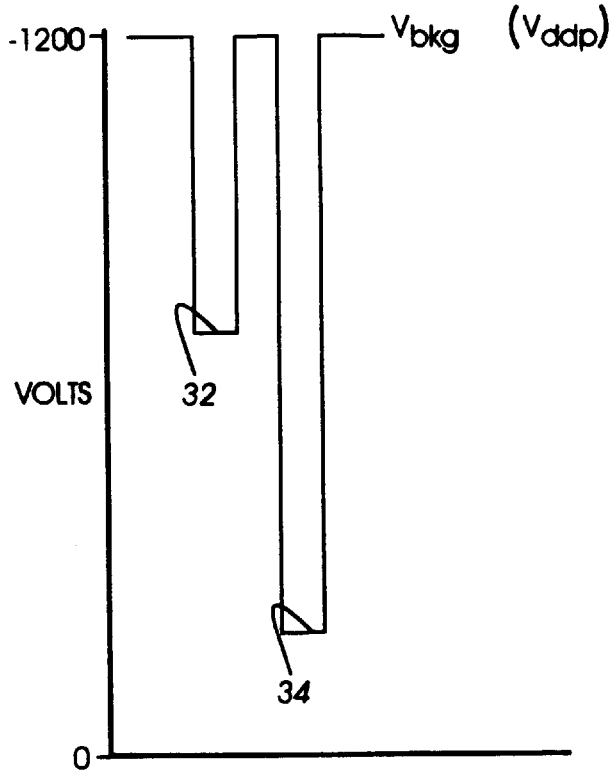
FIG. 1*b* depicts the voltage profile of a pair of discharged area images after exposure using a ROS.
Figure 1C:
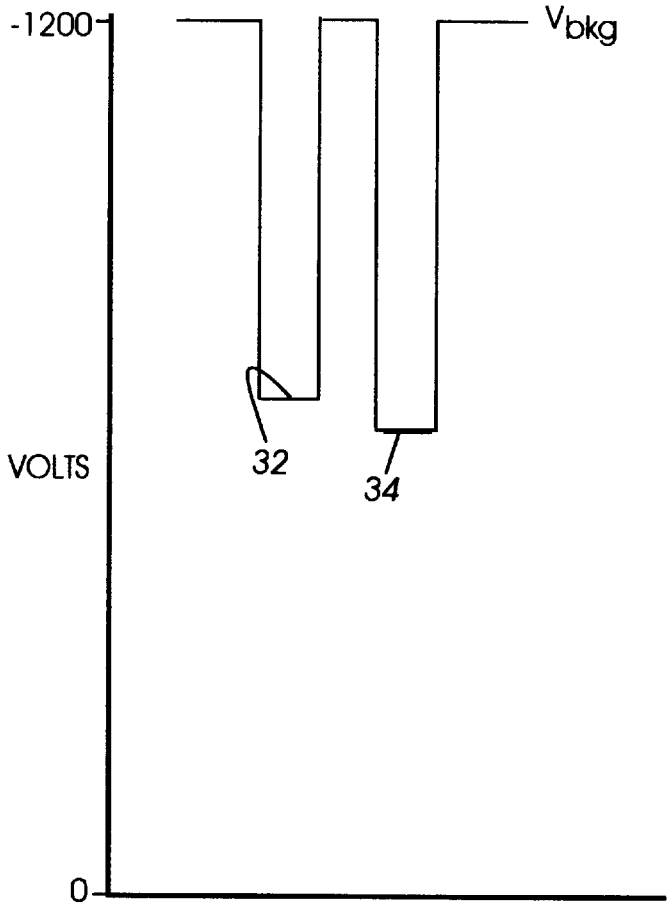
FIG. 1*c* depicts the voltage profile of the discharged area images of FIG. 1*b* after development of one of the pair of images.
Figure 1D:
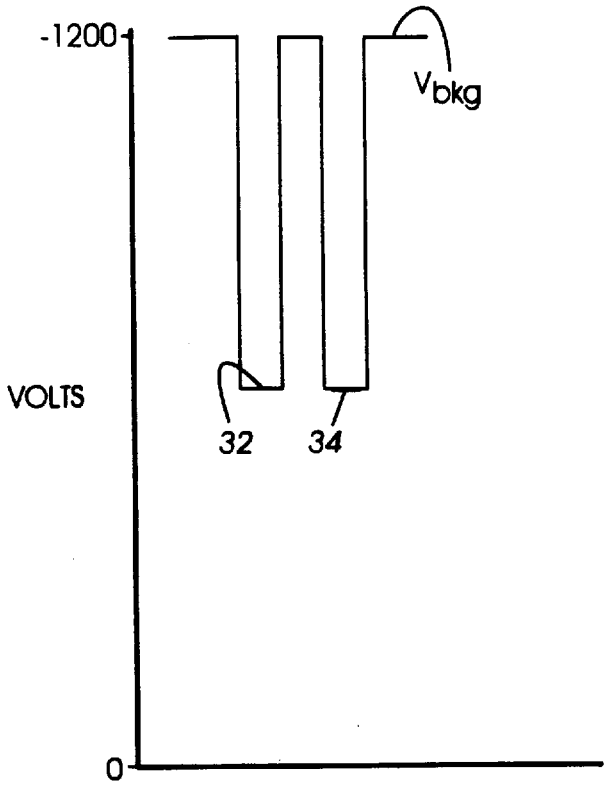
FIG. 1*d* depicts the voltage profile of the discharged area images of FIG. 1*c* after a recharging step.

A corona discharge device, for example, a scorotron 42 positioned downstream of the developer structure 36 at a recharge station D serves to neutralize the toner image 34 to approximately the voltage level of the latent image 32 (FIG. 1*d*). For the purpose of this disclosure, images such as images 32 and 34 refer to both the latent images formed at the exposure station B as well as developed images developed using developer structures such as structure 36.

A partial erase arrangement positioned at erase station E comprises a light pipe 46, a lamp 48 and a variable power supply 50. The partial erase arrangement serves to reduce the latent image voltages 32 such that the background voltage, $V_{bkg}$, is approximately equal the voltage of the charged neutralized images 34 and to create a sufficient delta between the images 32 and 34 to allow for development of images 32. To this end, a second developer housing structure 52 containing red toner 54 forming a part of developer contained in developer housing structure 52 at development station F is provided. The developer housing structure 52 is also a magnetic brush developer structure similar to the structure 36. An electrical bias, is applied to the developer structure 52 via source 53 for effecting development of image 32 with red toner.

Subsequent to image development a sheet of support material 55 is moved into contact with the toner images at transfer station M. The sheet of support material is advanced to transfer station M by conventional sheet feeding apparatus, not shown. Preferably, the sheet feeding apparatus includes a feed roll contacting the uppermost sheet of a stack copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station M.

Transfer station M includes a transfer corona discharge device 56 which sprays positive ions onto the backside of sheet 55. This attracts the negatively charged toner powder images from the belt 10 to sheet 55. A detack dicorotron 58 is provided for facilitating stripping of the sheets from the belt 10.

After transfer, the sheet continues to move, in the direction of arrow 60, onto a conveyor (not shown) which advances the sheet to fusing station N. Fusing station H includes a fuser assembly, indicated generally by the reference numeral 63, which permanently affixes the transferred powder image to sheet 55. Preferably, fuser assembly 62 comprises a heated fuser roller 65 and a backup or pressure roller 67. Sheet 55 passes between fuser roller 65 and backup roller 67 with the toner powder images contacting fuser roller 65. In this manner, the toner powder images are permanently affixed to sheet 55 after being allowed to cool. After fusing, a chute, not shown, guides the advancing sheets 55 to a catch tray, not shown for subsequent removal from the printing machine by the operator.

After the sheet of support material is separated from photoconductive surface of belt 10, the residual toner particles carried by the non-image areas on the photoconductive surface are removed therefrom. These particles are removed at cleaning station O using a cleaning brush structure contained in a housing 69.

The voltage profiles on the photoreceptor 10 depicting the image forming process steps just described are illustrated FIG. 1*a* through 2*f*. FIG. 1*a* illustrates the voltage profile on photoreceptor belt after the belt has been uniformly charged to a negative voltage of −1250 volts. The photoreceptor is initially charged to a voltage slightly higher than the voltage indicated but after dark decay the voltage level is slightly less as shown.

The present invention as described above with reference to FIG. 3 was accomplished by modifying the ROS of the 4850TM highlight color printer apparatus to create the discharged area images 32 and 34. A green developer housing 36 is utilized for effecting Discharged Area Development (DAD) of the images 34, the developer housing structure 52 containing red toner for development of the discharged area images 32. Additionally, the light pipe 46, the lamp 48 and the variable power supply 50 were placed between the developer housings 36 and 52, external to the photoreceptor module, as illustrated.

The relative voltages of the two DAD image voltages 32 and 34 prior to the movement of these images past the green housing are depicted in FIG. 1*b*. The voltages shown represent negative values. Thus, the image 34 which is developed first by the developer housing structure 36 has a lower voltage than the second image 32. The delta or difference between the two voltages of images 32 and 34 is sufficient to permit full development of image 34 using a first bias voltage, while maintaining a cleaning field between the bias voltage and image 32.

FIG. 1*c* depicts the relative voltages of the two DAD images 32 and 34 subsequent to the development of image 34 and prior to the recharge and partial erase steps mentioned above. As shown, the deposition of the green toner on image 34 has the effect of charge neutralizing image 34 to almost but not quite the voltage level of image 32. Recharging of the image 34 using the scorotron 42 as shown in FIG. 1*d* has the effect of further charge neutralizing the developed image 34 such that it is at approximately the voltage level of the yet to be developed image 32. Following recharging of the images on the photoreceptor, the images are subjected to a partial erase step using the light pipe 46, the lamp 48 and the variable power supply 50. The purpose of the partial erase is to reduce the image voltages such that the background voltage $V_{bkg}$, almost equals the voltage of the neutralized image 34 and to create a sufficient delta or difference between image 32 and image 34 to allow development of image 32 by the second developer housing 52 electrically biased to a suitable voltage level producing a cleaning field relative to image 34.

Figure 1E:
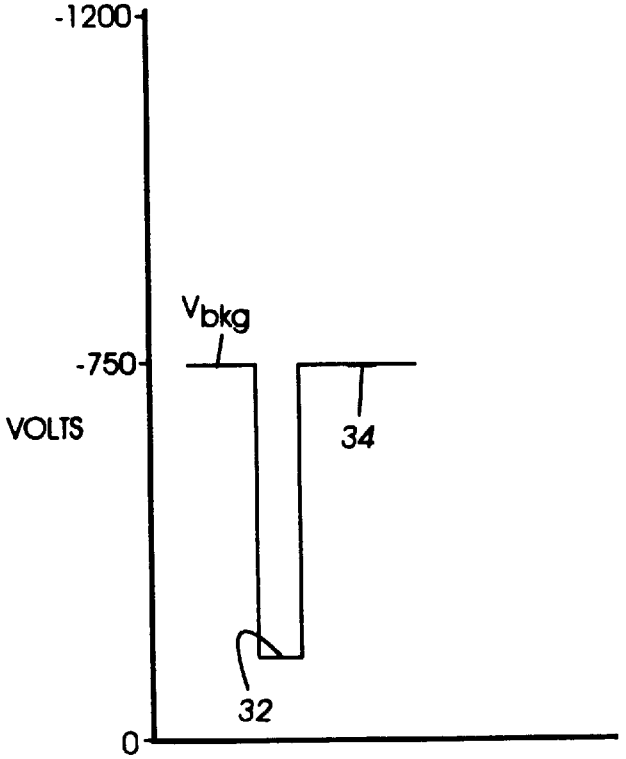
FIG. 1*e* depicts the voltage profile of the discharged area images of FIG. 1*d* after a partial erase step.
Figure 1F:
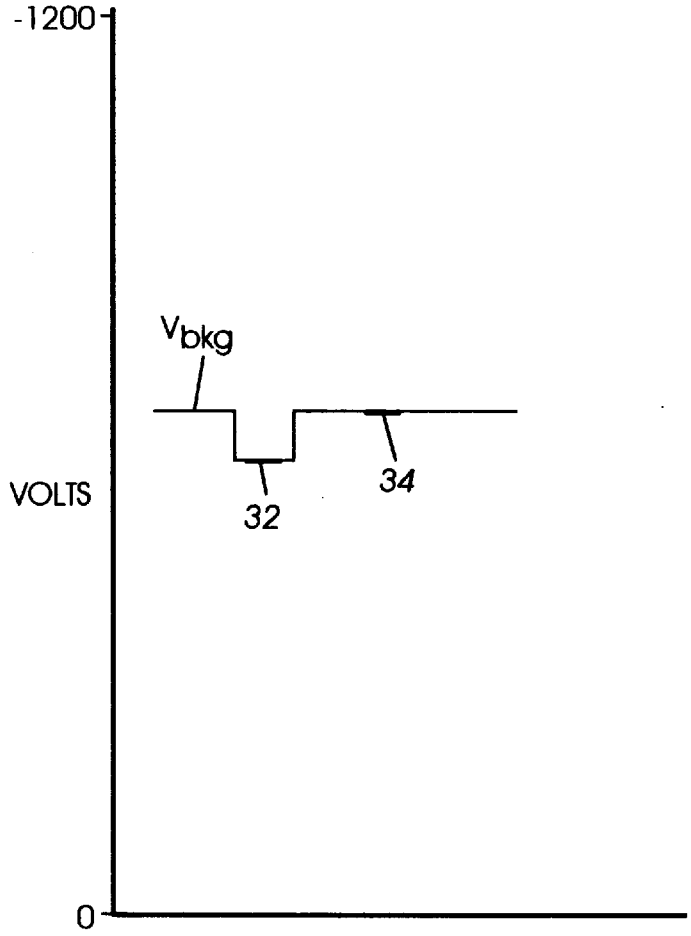
FIG. 1*f* depicts the voltage profile of the discharged area images of FIG. 1*e* after development of the other of a pair of discharged area images.

FIG. 1*e* illustrates the relative voltages of images 32 and 34 subsequent to the partial erase step. The effect of the partial erase step as shown in FIG. 1*e* results in voltage level of image 32 being substantially reduced along with the background voltage levels, $V_{bkg}$. The partial erase step has little or no effect on the voltage level of already developed image 34 as shown in FIG. 1*e*. FIG. 1*f* illustrates the relative voltages of images 32 and 34 subsequent to development of image 32. As the result of the development of image 32, that voltage level is substantially charged neutralized to almost the voltage level of developed image 34.

Figure 4:
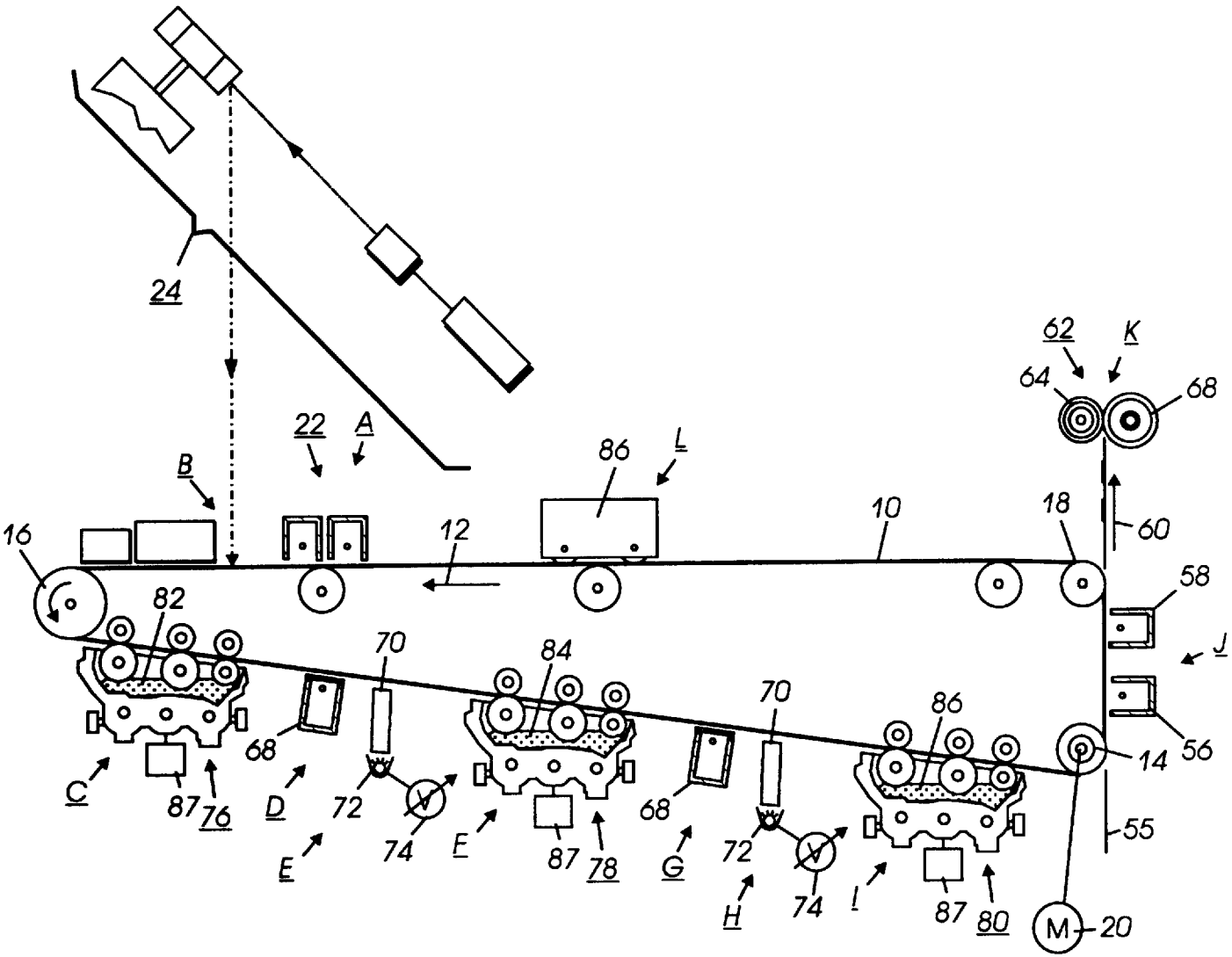
FIG. 4 is a schematic illustration of another xerographic engine incorporating the present invention.

In an embodiment of the invention disclosed in FIG. 4, a ROS 24 is adapted to form three DAD images 62, 64 and 66 which images are depicted in FIGS. 2*a* through 2*h*. As shown in FIG. 4, combinations of a recharge device 68 (stations D and G) and a partial erase device (stations E and H) comprising a light pipe 70, lamp 72 and a variable power source 74 are provided intermediate developer structures 76 and 78 and between structures 78 and 80.

The developer structures 76, 78 and 80 (stations C, F and I) contain developer 82 including black toner, a first developer containing color toner 84 and a second developer containing color toner 86, the black developer being contained in the developer structure 76 and the color developers being contained in the developer structures 78 and 80. Electrical biasing of the developer structures is effected using a voltage source 87.

Figures 2A, 2B, 2C:
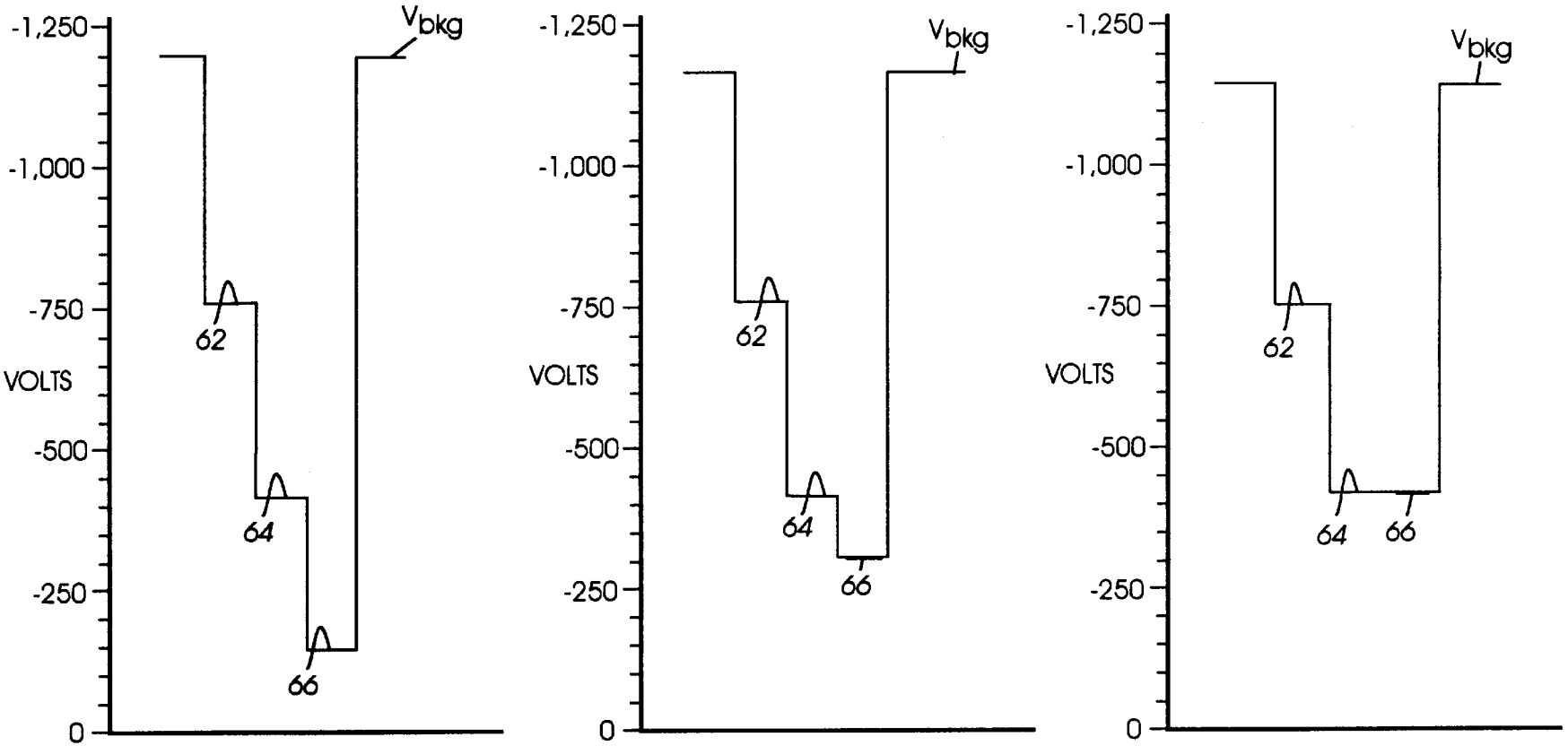
FIG. 2*a* depicts the voltage profile of three discharged area images after exposure using a ROS.
FIG. 2*b* depicts the voltage profile of the discharged area images of FIG. 2*a* after development of one the images.
FIG. 2*c* depicts the voltage profile of the discharged area images of FIG. 2*b* after a recharging step.
Figures 2D, 2E, 2F:
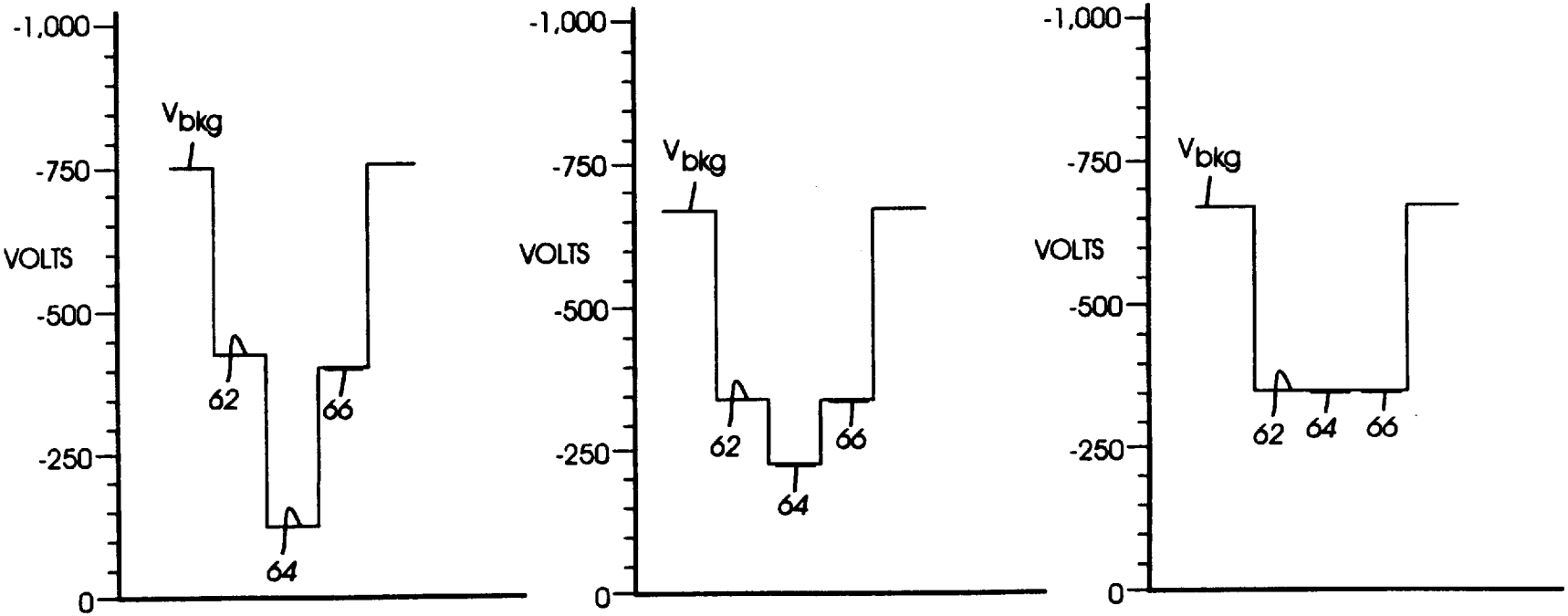
FIG. 2*d* depicts the voltage profile of the discharged area images of FIG. 2*c* after a partial erase step.
FIG. 2*e* depicts the voltage profile of the discharged area images of FIG. 2*d* after development of another one of the three images.
FIG. 2*f* depicts the voltage profile of the discharged area images of FIG. 2*e* after a second recharge step.
Figure 2G:
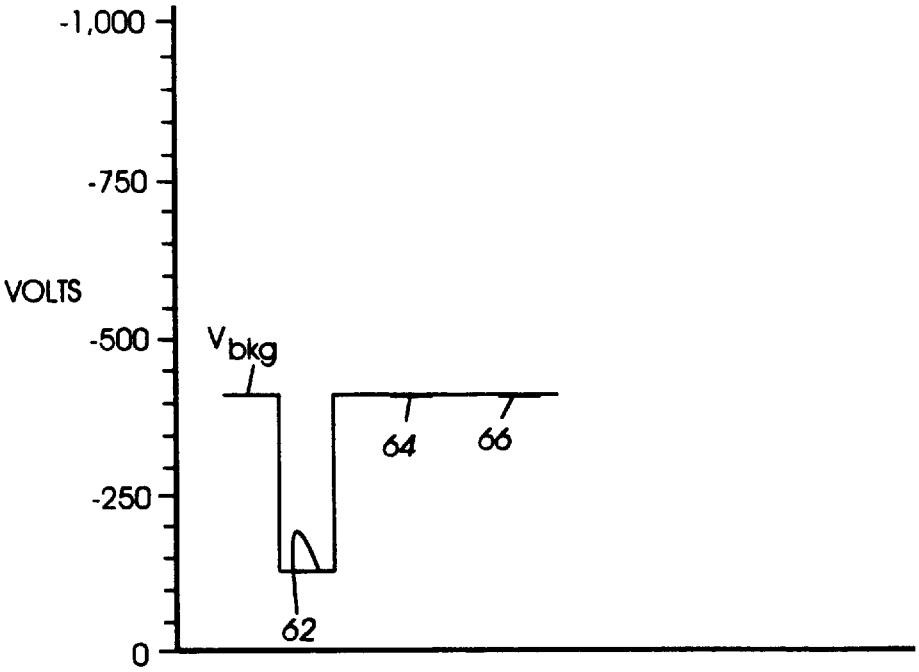
FIG. 2*g* depicts the voltage profile of the discharged area images of FIG. 2*f* after a second partial erase step.

The voltage profiles of the images 62, 64 and 66 are depicted in FIGS. 2*a* through 2*h*. FIG. 2*a* illustrates the three DAD images 62, 64 and 66. formed using the ROS 24. The voltages of the three images are approximately −750, −450 and −125 volts, respectively. The image 66 is developed first using the developer structure 76 containing black toner thereby effecting charge neutralization of that image as shown in FIG. 2*b*. A developer bias equal to about −275 volts is applied to the developer structure 76. Further charge neutralization (FIG. 2*c*) of the developed image 66 is effected using the recharge device 68 to increase the magnitude of that image to approximately the voltage level of image 64. The images are then subjected to partial erase using the light pipe, lamp and variable power supply. The effect of the partial erase step, as shown in FIG. 2*d*, is to reduce the background voltage, $V_{bkg}$ from about −1200 volts to approximately −750 volts and to reduce the voltage levels of images 62 and 64 to −425 and −125 volts, respectively.

Figure 2H:
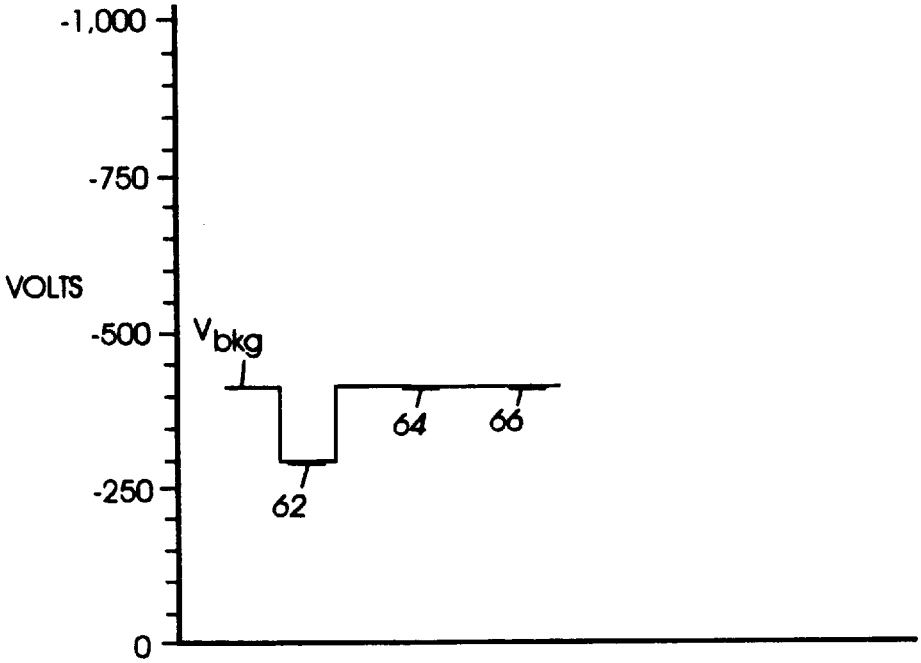
FIG. 2*h* depicts the voltage profile of the discharged area images of FIG. 2*g* after the development of the last of the discharged area images.

At this point, image 64 has been conditioned for development using developer structure 78 containing the first developer containing color toner 84. A bias voltage of about −275 volts is applied to the developer structure 78. This results in a cleaning field of about −150 volts. The magnitude (−275 volts) of the bias is sufficient for effecting deposition of color toner onto image 64 while the cleaning field of −150 volts precludes development of images 62 and 66 with developer 84. Development of image 64, as seen in FIG. 2*e*, has not been completely charge neutralized so the images are subjected to recharging using recharge device 68 which, as shown, in FIG. 2*f*, serves to complete charge neutralization of image 64 such that its voltage level is at about the voltage level of image. An additional partial erase step, as can be seen from FIG. 2*g*, reduces the magnitude of the background voltage and the image 62 so that the latter is conditioned for development with color developer 86 deposited on image 62 using developer structure 80. As in the case of the use of developer structures 78 and 80, a bias voltage of about −275 volts is applied to the developer structure 80 producing a cleaning field of about −150 volts. The final voltage profile, as shown in FIG. 2*h*, depicts developed unipolar images 62, 64 and 66. Subsequent to image development a sheet of support material 55 is moved into contact with the toner images at transfer station M. The sheet of support material is advanced to transfer station M by conventional sheet feeding apparatus, not shown. Preferably, the sheet feeding apparatus includes a feed roll contacting the uppermost sheet of a stack copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station M.

Transfer station M includes a transfer corona discharge device 56 which sprays positive ions onto the backside of sheet 55. This attracts the negatively charged toner powder images from the belt 10 to sheet 55. A detack dicorotron 58 is provided for facilitating stripping of the sheets from the belt 10.

After transfer, the sheet continues to move, in the direction of arrow 60, onto a conveyor (not shown) which advances the sheet to fusing station N. Fusing station N includes a fuser assembly, indicated generally by the reference numeral 63, which permanently affixes the transferred powder image to sheet 55. Preferably, fuser assembly 63 comprises a heated fuser roller 65 and a backup or pressure roller 67. Sheet 55 passes between fuser roller 65 and backup roller 67 with the toner powder images contacting fuser roller 65. In this manner, the toner powder images are permanently affixed to sheet 55 after being allowed to cool. After fusing, a chute, not shown, guides the advancing sheets 55 to a catch tray, not shown for subsequent removal from the printing machine by the operator.

After the sheet of support material is separated from photoconductive surface of belt 10, the residual toner particles carried by the non-image areas on the photoconductive surface are removed therefrom. These particles are removed at cleaning station 0 using a cleaning brush structure contained in a housing 69.

We claim:

1. Tri-level imaging apparatus including means for forming monopolar charge patterns having at least three different voltage levels on a charge retentive surface wherein two of the voltage levels correspond to two discharged image areas and the third background voltage level corresponds to a background area, said apparatus comprising:

means including first developer housing containing developer materials for forming a first powder image in one of said two discharged image areas;

means for neutralizing, prior to forming a second powder image in another of said two discharged image areas, the charge level of said one of said two discharged image areas such that it approximately equals the charge level of said another of said two discharged image areas;

means for conditioning, prior to forming a second powder image in another of said two discharged image areas, said two discharged image areas and said background voltage level for enabling development of said another of said two discharged image areas;

a second developer housing containing developer materials contrasting with said developer materials forming said first powder image for developing said another of said two discharged image areas; and means for sequentially moving said uniformly charged, charge retentive surface past said first developer housing, said charge neutralizing means, said conditioning means and said second developer housing.

2. Apparatus according to claim 1 including means for conditioning comprises means for providing a voltage difference between said one and said another discharged image areas and causes said background voltage to be altered such that it is approximately equal to said one discharged image area.

3. Apparatus according to claim 2 wherein said means for conditioning comprises an illumination means.

4. Apparatus according to claim 3 wherein said illumination means comprises a lamp and a light pipe.

5. Apparatus according to claim 4 wherein said illumination means further comprises a variable power source.

6. Apparatus according to claim 5 including means for forming at least another discharged image area simultaneously with the formation of said two discharged image areas.

7. Apparatus according to claim 6 including additional development means for developing said at least another discharged area image and including additional means for neutralizing the charge level of said at least another discharged image area and additional means for conditioning said two discharged image areas after development of said two discharged area images and prior to development of said at least another discharged image for optimization of cleaning fields and providing sufficient voltage space between said two discharged image areas and said at least another discharged image area for enabling development of said at least another discharged image area.

8. Apparatus according to claim 7 wherein said additional means for neutralizing the charge level of said at least another discharged image area comprises an illumination source.

9. Apparatus according to claim 8 wherein said additional means for neutralizing the charge level of said at least another discharged image area further comprises light pipe.

10. A method of creating tri-level images including the steps of:

forming monopolar charge patterns having at least three different voltage levels on a charge retentive surface wherein two of the voltage levels correspond to two discharged image areas and the third background voltage level corresponds to a background area;

using a first developer housing containing developer materials, for forming a first powder image in one of said two discharged image areas;

prior to forming a second powder image in another of said two discharged image areas, conditioning said two discharged image areas and said background voltage level for enabling development of said two discharged area images; and using a second developer housing containing developer materials contrasting with said developer materials forming said first powder image, developing said another of said two discharged image areas.

11. The method according to claim 10 said step of conditioning is effected by providing a voltage difference between said one and said another discharged image areas and causing said background voltage to be altered such that it is approximately equal to said one discharged image area.

12. The method according to claim 11 wherein said step of conditioning is effected using illumination means.

13. The method according to claim 12 wherein said illumination means comprises a light pipe and a lamp.

14. The method according to claim 13 wherein said illumination means further comprises a variable power source.

15. The method according to claim 14 including the step of forming at least another discharged image area simultaneously with the formation of said two discharged image areas.

16. The method according to claim 15 including using additional development means for developing said at least another discharged area image and using additional means for neutralizing the charge level of said at least another discharged image area and additional means for conditioning said two discharged image areas after development of said two discharged area images and prior to development of said at least another discharged image for optimization of cleaning fields and providing sufficient voltage space between said two discharged image areas and said at least another discharged image area for enabling development of said at least another discharged image area.

17. The method according to claim 16 wherein said additional means for neutralizing the charge level of said at least another discharged image area comprises an illumination source.

18. The method according to claim 17 wherein said additional means for neutralizing the charge level of said at least another discharged image area further comprises a light pipe.

* * * * *